United States Patent [19]

Goldstein

[11] 4,382,407

[45] May 10, 1983

[54] PLASTIC MOUNT FOR A STAMPING DIE

[75] Inventor: Edwin W. Goldstein, Scarsdale, N.Y.

[73] Assignee: Crown Marking Equipment Co., Philadelphia, Pa.

[21] Appl. No.: 256,736

[22] Filed: Apr. 23, 1981

[51] Int. Cl.[3] ..... B41K 1/56

[52] U.S. Cl. ..... 101/405; 40/328

[58] Field of Search ..... 101/405, 406; 40/328

[56] References Cited

U.S. PATENT DOCUMENTS

| | | | |
|---|---|---|---|
| 2,195,994 | 4/1940 | Morse | 101/405 |
| 3,315,601 | 4/1967 | Borack | 101/405 X |
| 3,388,662 | 6/1968 | Ravreby | 101/405 |
| 3,759,180 | 9/1973 | Gibbons et al. | 101/405 |
| 3,855,925 | 12/1974 | Funahashi | 101/405 X |

OTHER PUBLICATIONS

Websters Seventh New Collegiate Dictionary-Merriam Co., Springfield, Mass. p. 226.

*Primary Examiner*—Edgar S. Burr
*Assistant Examiner*—Charles Pearson
*Attorney, Agent, or Firm*—Hedman, Casella, Gibson, Costigan & Hoare

[57] ABSTRACT

A plastic mount for a stamping die and a method for manufacturing the same is disclosed. The mount has an elongated tubular base of rectangular cross section and includes a handle projecting from the upper surface of the base. A pair of longitudinally extending ribs project downwardly from the lower surface of the base for aligning a stamping die. The upper surface of the base includes a pair of rib portions which are spaced apart such that a separation is defined therebetween. The separation is aligned with the handle and is at least as large as the longitudinal width of the handle at its juncture with the base. The rib portions cooperate with a rib on the bottom surface for receiving and retaining a C-shaped transparent strip. The stamp is formed from two segments by an injection molding technique which does not require cam action mechanisms.

7 Claims, 8 Drawing Figures

PLASTIC MOUNT FOR A STAMPING DIE

BACKGROUND OF THE INVENTION

The subject invention relates to a plastic mount for a stamping die. More specifically, a mount formed by an injection molding technique is disclosed having a sturdy construction including an integral handle.

In the prior art, stamp mounts adapted to retain a stamping die are used for transferring inked indicia from the die to a substrate. A conventional mount generally includes an elongated tubular base, of rectangular cross-section, having a handle connected thereto. The bottom surface of the base is provided with a pair of longitudinally extending ribs defining a boundary for aligning a cushion and the stamping die. In use, after inking the die from a pad, pressure is placed on the stamp mount to transfer the indicia from the die to a substrate. Since the indicia on the die is embossed in mirror image fashion, it is desirable to provide some form of marking on the front surface of the mount to identify the die. Typically, the means for identifying the die includes a paper card having indicia printed thereon corresponding to the indicia on the die. The paper card is interposed between the front surface of the base and a C-shaped transparent strip. A rib extending along the top surface of the base, contiguous with the front surface thereof, cooperates with a rib on the bottom surface of the base to slidably receive and retain the C-shaped strip. By this arrangement, the C-shaped strip holds and protects the paper card such that the indicia, printed thereon, may be easily read.

In the prior art the labor costs associated with the production of stamp mounts have been fairly high. More particularly, the manufacturer of stamp mounts generally purchases long strips of wood having the above described ribs configured therein. When orders are placed for particular stamps, a strip of wood is cut into segments having a length sufficient to contain the corresponding indicia. After the segments of wood have been cut, it is necessary to finish each piece individually. For example, the ends of each piece must be sanded to prevent injury to the user and to improve its aesthetic appearance. Thereafter, a hole is drilled in the top surface of the base to permit the attachment of a handle, which may be formed from either plastic or wood. Accordingly, while the material costs of the wood base itself is fairly low, the total cost to the consumer, which includes the labor of finishing the mount is relatively high. Another shortcoming of the prior art mounts is that the connection, between the handle and the base, frequently becomes loose from repeated use, thereby resulting in a separation therebetween, rendering the mount inoperable.

Accordingly, efforts have been made to produce stamp mounts of sturdier construction, having fixed sizes such that labor costs for finishing, which are continually escalating, are eliminated. One solution that has been proposed is the use of a preformed plastic mount having an integral handle. As can be appreciated, while the material cost of plastic may be slightly higher than wood, if a mount could be molded relatively inexpensively, the total cost of the mount to the consumer would be less than the prior art mount which included high finishing costs. It is apparent that a one piece, non-hollow mount solidly molded from plastic could never satisfy the cost criteria since the amount of plastic necessary to form a solid mount would be prohibitively expensive. Accordingly, attempts have been made to develop hollow mounts, formed from front and rear segments joined together, in order to substantially reduce the cost of materials.

Various problems arose when attempts were made to produce a hollow, two-part plastic stamp. More specifically, when producing the front segment of a two-part plastic stamp mount, the mold must be designed to include interior recesses for defining the upper and lower cooperating ribs which receive and retain the C-shaped transparent strip. In the molding operation, the ribs become entrapped in the recesses such that sophisticated cam mechanisms are required to eject the finished part from the mold. As can be appreciated, molding operations which require cam action mechanism are significantly higher in cost. In addition, cam action molding is slower and is more likely to malfunction than simpler molding techniques. Further, when forming stamps of relatively smaller dimensions, space restrictions prevent the use of a cam action mold.

Accordingly, it is an object of the subject invention to provide a new and improved plastic mount for a stamping die which may be produced by a molding technique without cam action mechanisms.

It is another object of the subject invention to provide a new and improved plastic mount for a stamping die which is hollow and formed of two connected segments.

It is a further object of the subject invention to provide a new and improved plastic mount for a stamping die wherein the handle is formed integrally with the base providing a sturdy construction.

SUMMARY OF THE INVENTION

In accordance with these and many other objects the subject invention provides for a new and improved plastic mount for a stamping die. The mount is defined by an elongated tubular base of rectangular cross-section having closed ends. A handle is provided projecting upwardly from the center of the top surface of the base. The bottom surface of the base includes a pair of longitudinally extending opposed parallel ribs which project downwardly therefrom, contiguous with the front and rear surfaces respectively. The opposed lower ribs define a boundary for the placement of a cushion and the stamping die.

The subject mount is formed from front and rear hollow segments which are defined by a central vertical plane that extends parallel to the longitudinal axis of the base. In accordance with the subject invention, the front segment further includes a means, which cooperates with the lower rib formed thereon, to receive and retain a longitudinally extending C-shaped transparent strip. By this arrangement, a card identifying the indicia of the die may be displayed by interposing the card between the strip and the front surface of the base. The means includes a pair of longitudinally extending rib portions, projecting upwardly from the upper surface of the base, contiguous with the front surface thereof. The rib portions are spaced apart such that a separation is defined therebetween. In accordance with the subject invention, the separation is aligned with the handle and is at least as large as the longitudinal width of the handle, measured at its juncture with the base. The rib portions cooperate with the lower rib on the front segment for retaining the transparent C-strip.

The front and rear segments can be ultrasonically welded together to provide a structurally rigid assembly wherein the handle is formed integrally with the base. Of greater significance, both the front and the rear segments can be manufactured in an improved molding process which does not require the slower and less reliable cam action mechanism. More specifically, the front and rear segments of the mount are injection molded between opposed core and cavity mold halves. When the rear segment is molded, the parting line between the core and cavity mold halves, defined on the bottom surface of the base, extends along the associated lower rib thereof. The parting line defining the remainder of the rear segment corresponds to and extends along the vertical plane defining the segment. By this arrangement, the rear segment can be readily released from the core after the plastic is cooled.

In accordance with the subject invention the unique configuration of the front segment also permits the part to be readily ejected from the mold without a cam action mechanism. More specifically, in the injection molding of the front segment, the parting line between mold halves defining the bottom surface of the base extends along the associated lower rib. Further, the portion of the parting line defining the top surface of the base extends along the unique spaced apart rib portions. The parting line defining the remainder of the front segment corresponds to and extends along the vertical plane defining the segment. By this arrangement, and as discussed more fully hereinbelow, the cavity section of the mold, which defines the outer surface of the handle, can be freely withdrawn from the molded part without having to shift or move the part clear of the rib. A plastic mount formed in accordance with the subject invention is relatively easy to manufacture, has increased structural rigidity, and can be produced in fixed sizes thereby eliminating labor costs for finishing.

Further objects and advantages of the subject invention will become apparent from the following detailed description, taken in conjunction with the drawings in which:

DESCRIPTION OF THE PREFERRED EMBODIMENT

Figure 1:
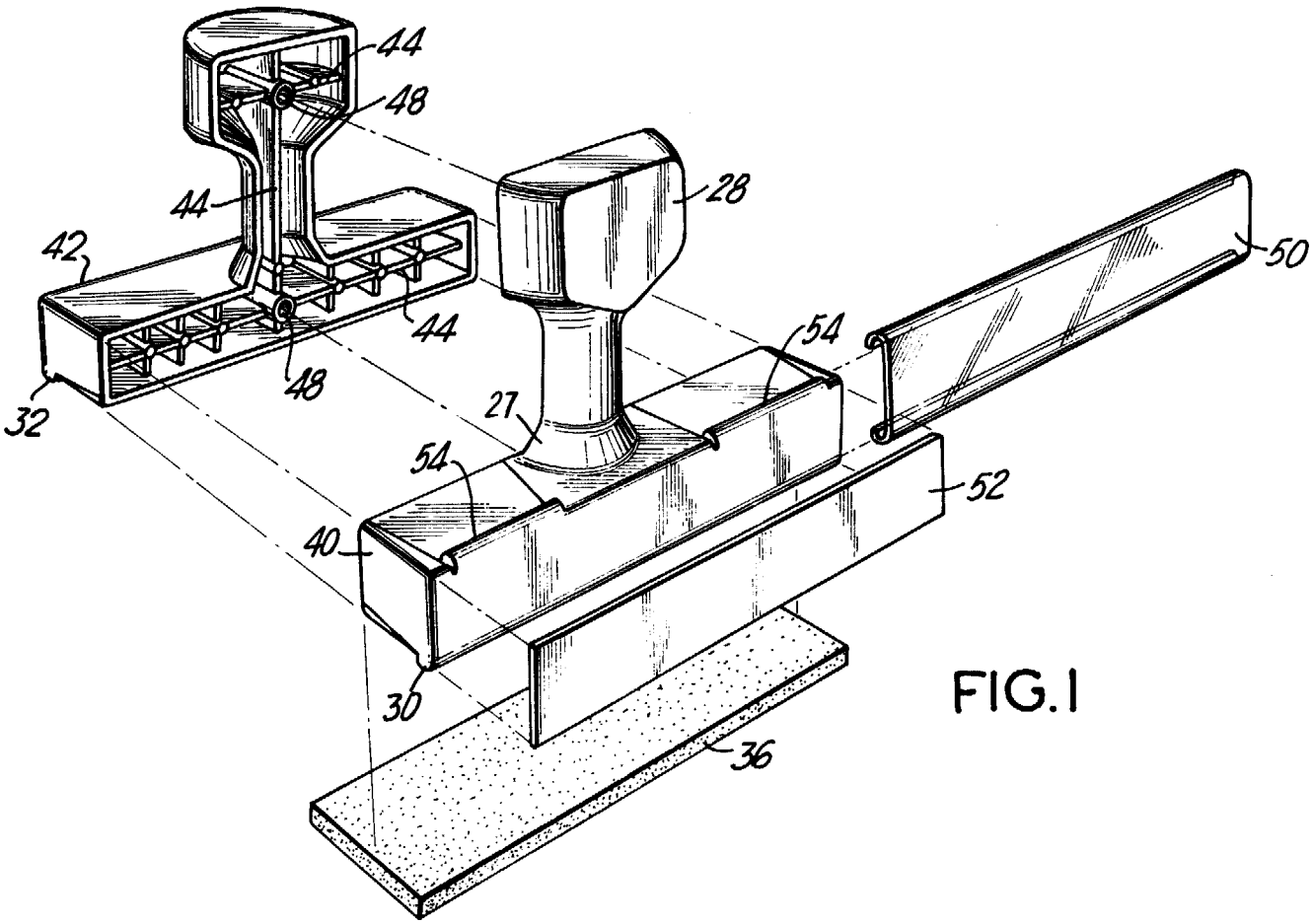
FIG. 1 is an exploded perspective view of the new and improved mount for a stamping die illustrating the front and rear segments.
Figure 2:
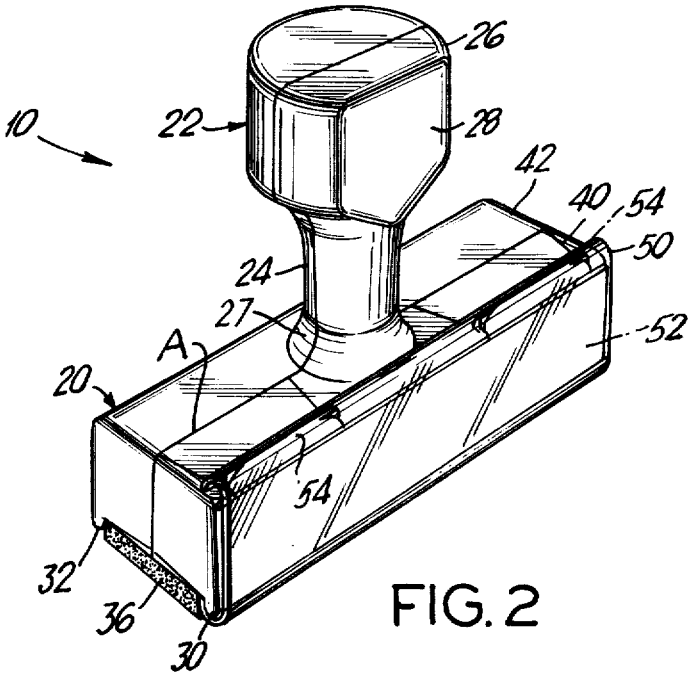
FIG. 2 is a perspective view of the new and improved plastic mount for a stamping die of the subject invention.
Figure 3:
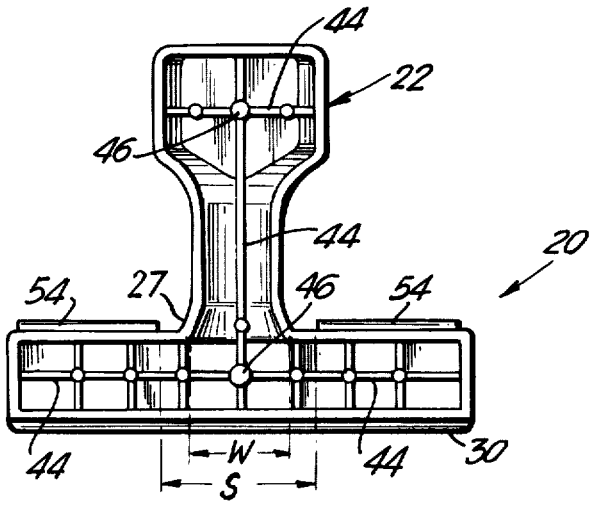
FIG. 3 is an elevational view of the front segment of the new and improved mount of the subject invention as seen from the rear.

Referring to FIGS. 1 through 3, the new and improved stamp mount 10 of the subject invention is illustrated. The mount 10 is defined by an elongated tubular base 20 of rectangular cross section, having closed ends. A handle 22 projects upwardly from the center of the top surface of the base 10. Preferably, the handle includes a cylindrical stem 24 which flares outwardly into an upper knob portion 26. To provide added structural rigidity the cylindrical stem 24 also flares outwardly and is contiguous with the base at 27. The front surface of the knob portion 26 may include a planar area 28 for the printing of trademark indicia or the like.

The bottom surface of the base 20 includes a pair of opposed, longitudinally extending ribs 30 and 32 formed contiguously with the front and rear surfaces of the base respectively. The lower ribs function to define a boundary for locating a stamping die therebetween. Preferably, and as illustrated in FIGS. 1 and 2, a cushion 36 is initially adhesively joined to the bottom surface of the base 20. Thereafter, a stamping die (not shown) having indicia embossed thereon, is attached to the lower surface of cushion 36.

The subject mount 10 is formed from front and rear hollow segments 40 and 42, respectively, which are defined by a vertical plane extending parallel to the longitudinal axis of the base 20 and coinciding with line A, as illustrated in FIG. 2. Each of the segments is individually injection molded as described more fully hereinbelow. Both segments 40 and 42 are provided with internal structural rails 44 to add structural rigidity to the mount. Preferably, and as illustrated in FIG. 3, one of the segments is provided with locking pins 46 which are receivable in apertures 48 formed in the opposed segment. The interengagement between the apertures 48 and pins 46 facilitates alignment of the segments 40, 42 when they are assembled.

In accordance with the subject invention, the front segment 40 of the mount 10 includes a means, cooperating with lower rib 30, for receiving and retaining a C-shaped transparent plastic strip 50. As discussed above, since the indicia on the stamping die (not shown) is embossed in mirror image fashion, it is preferable to provide corresponding indicia on the front surface of the mount 10 for identification. Accordingly, a card 52, having the indicia printed thereon, a interposed between the front surface of the base and the transparent C-shaped strip 50 such that the indicia is protected and displayed. The means for securing the C-shaped strip 50 includes a pair of rib portions 54 which project upwardly from the upper surface of the base contiguous with the front surface thereof. The rib portions are spaced apart such that a separation S, as illustrated in FIG. 3 is defined therebetween. In accordance with the subject invention, the separation S is aligned with the handle 22 and is at least as large as the longitudinal width W of the handle measured at the juncture between the stem 24 and the base. Preferably, the opposed ends of the rib portions 54 extend towards but are spaced from the adjacent ends of the base 20. As will be appreciated from the following description of the method for forming the mount of the subject invention, the spaced apart rib portions 54 enable the front segment to be molded without requiring complex cam action mechanisms.

Figure 4:
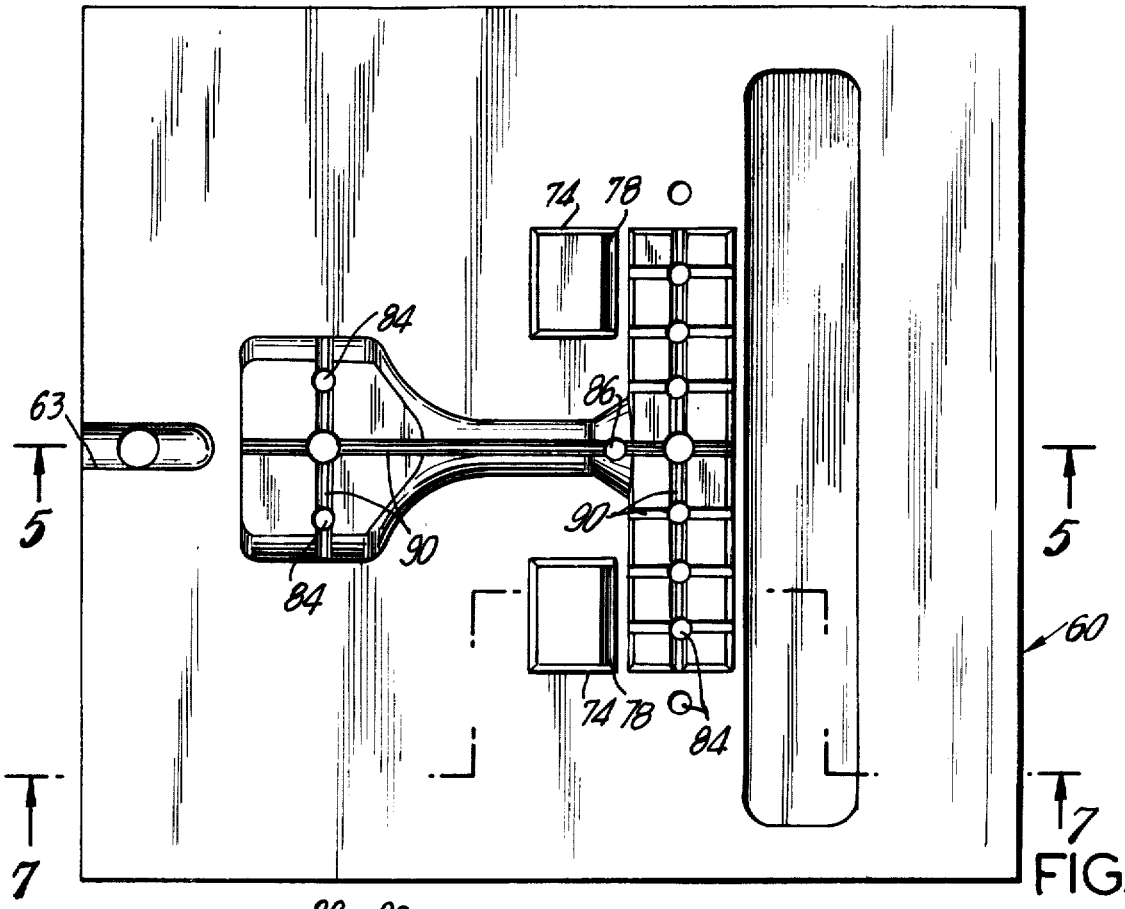
FIG. 4 is a top plan view of the core half of a mold used for forming the front segment of the mount in accordance with the subject invention.
Figure 5:
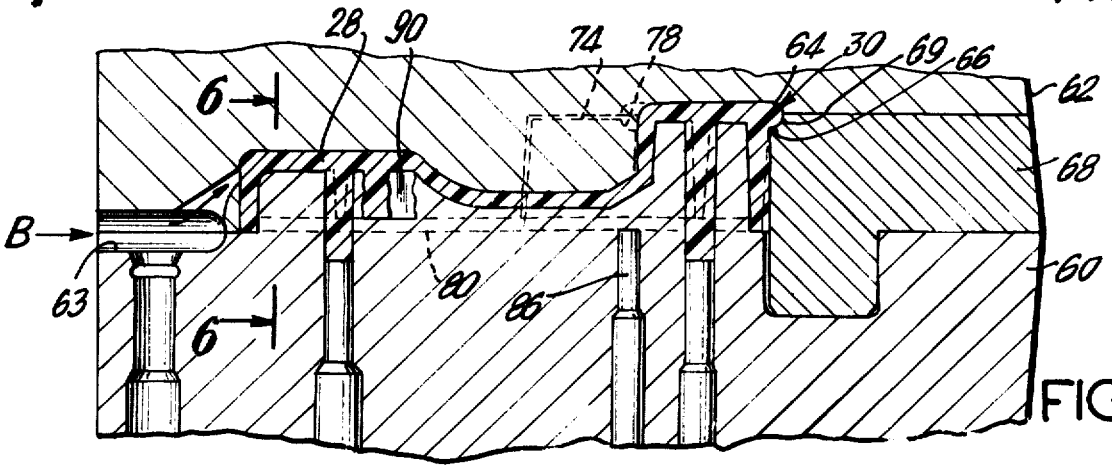
FIG. 5 is a cross sectional view taken along the line 5—5 in FIG. 4, illustrating the combination core and cavity mold halves for forming the front segment of the stamp mount in accordance with the subject invention.
Figure 6:
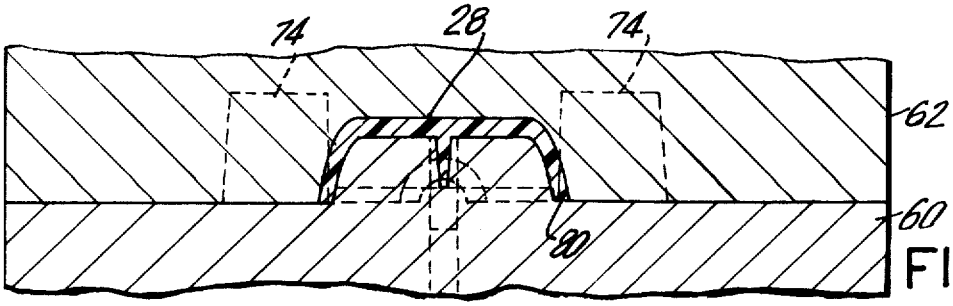
FIG. 6 is a cross sectional view, taken along the line 6—6 in FIG. 5, illustrating the combination core and cavity mold halves for forming the front segment of the stamp mount in accordance with the subject invention.

Referring now to FIGS. 4–8, the method of injection molding the stamping die will be more particularly described. The injection molding of the part takes place between a pair of opposed mold halves. More particularly, a core 60 and a cavity 62, having essentially complimentary configurations, are brought together such that the majority of their respective surfaces are in abutting contact, with a center void being defined therebetween. Molten plastic is injected into the void through a channel 63 along arrow B as illustrated in FIG. 5 to define the part. The mold halves 60 and 62, illustrated in FIGS. 4–8, are designed to produce a front segment 40 of the mount 10 of the subject invention.

Figure 7:
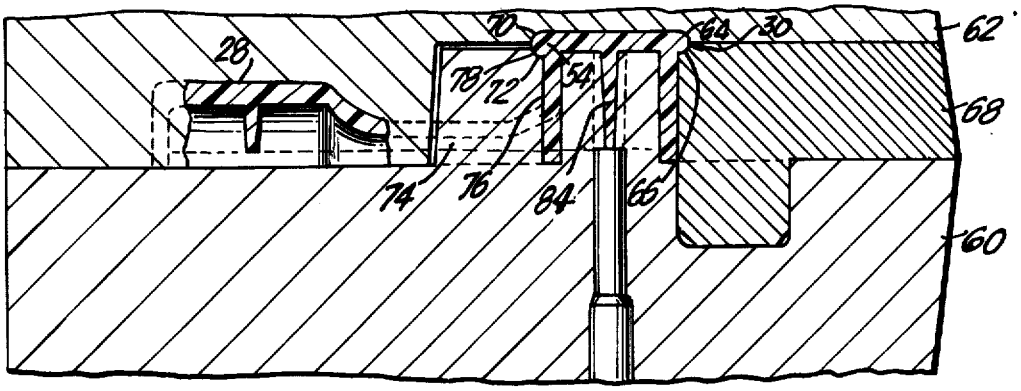
FIG. 7 is a cross sectional view, taken along the line 7—7 in FIG. 4, illustrating the combination core and cavity mold halves of the subject invention.
Figure 8:
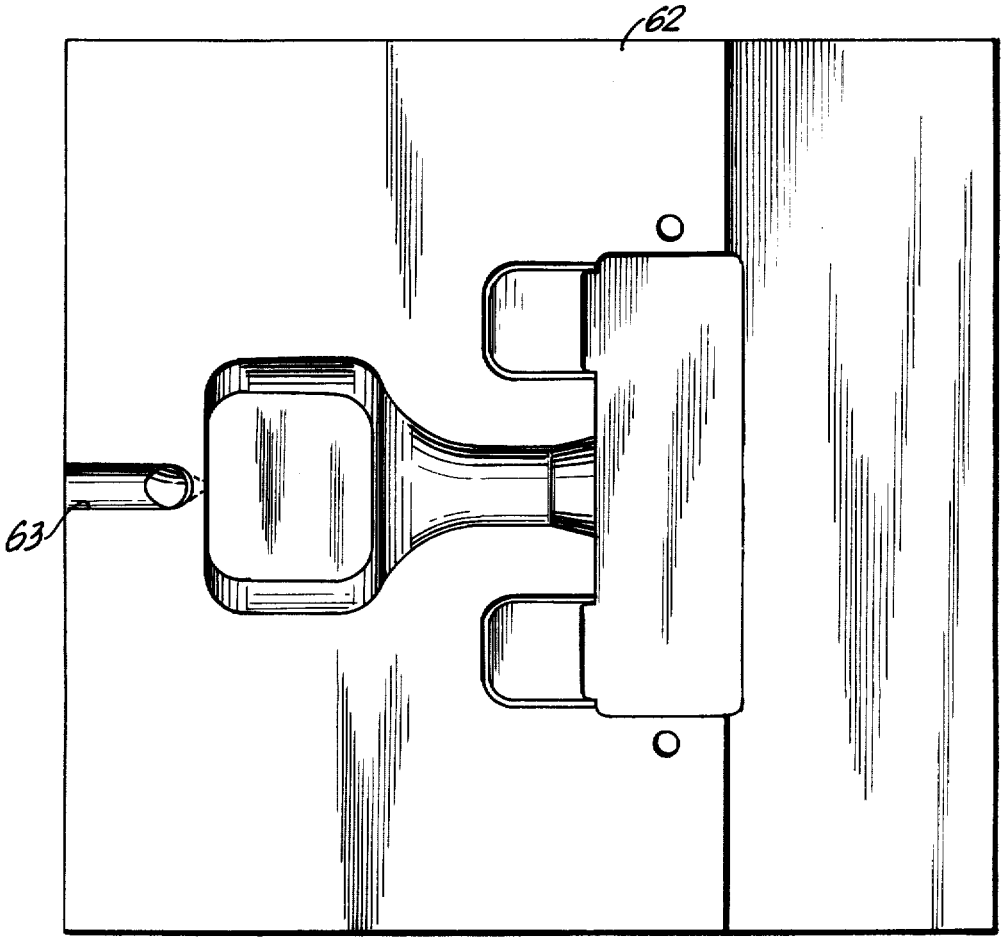
FIG. 8 is a top plan view of the cavity half of the mold for forming the front segment of the stamp mount in accordance with the subject invention.

As discussed above, in order to provide a molding method which does not require cam action mechanisms, it is necessary that no structural elements of the part be formed by internal recesses defined in either half of the mold. For example, when a rib is to be formed by an internal recess in a mold half, upon removal, the mold section would have to be shifted by camming in order to free the rib from the internal recess. Thus, the ribs of the subject mount must be formed without internal recesses. In accordance with the subject invention, the ribs of the base 20 are formed along the parting line between the core and cavity mold halves 60,62. More specifically, and as illustrated in FIGS. 5 and 7, it will be seen that front half 64 of lower rib 30 is formed by the cavity 62 while the rear half 66 of rib 30 is formed by the core 60. In the preferred embodiment of the subject invention, the core 60 consists of a solid metal body and a core insert 68 which is fixedly connected to the core 60. The core 60 and core insert 68 are initially formed as separate elements to reduce the tooling costs of the mold, however, both the core and the core insert can be considered as a single mold half with regard to the subject invention. The corner 69 of the core insert 68 is arcuate to define the rounded configuration of the rear half 66 of rib 30.

While the above described method for forming rib 30 does not require the use of cam action mechanisms, a similar technique could not be successfully used to mold a continuous upper rib. More specifically, if a full length rib was formed on the upper surface of the base and was defined by the parting line between the mold halves, it would be impossible to provide an integral, structurally rigid handle. In order to overcome this shortcoming, the subject invention provides for a mount 10 having a pair of longitudinally extending rib portions 54. As discussed above, the separation S between the rib portions 54 is aligned with the handle 22 and is at least as large as the longitudinal width W of the handle measured at its juncture with the base 20.

Accordingly, and as illustrated in FIG. 7, the core and the cavity are designed such that the front half 70 of each rib portion 54 is defined by the cavity 62 of the mold while the rear half 72 of each rib portions 54 is defined by the core. In order to produce this configuration, a pair of bosses 74 are formed in the core 60 which project upwardly from the surface thereof. The bosses 74 define the rear half 72 of each rib portion 54 as well as the top surface 76 of the base 20 disposed between and aligned with rib portions 54. Each boss 74 includes an arcuate portion 78 for defining the arcuate configuration of the rear half 72 of each rib portion 54. In contrast, and as illustrated in FIG. 5, the parting line 80 between the cavity and core halves of the remainder of the mold is coincident with the vertical plane which defines the front and rear segments of the mount 10, such that an integral handle can be formed. By this arrangement, after the plastic has been injected and cooled, the cavity 62 is freely separable from the core 60 such that the part may be pushed free from the core without cam action mechanisms.

Preferably, and as illustrated in FIG. 4, a plurality of holes 84 are provided in the core 60. Reciprocating knockout pins (not shown) are located in channels 86 within the core (FIG. 5). At the end of each molding cycle, the knockout pins are forced through the holes 84 in order to drive the part free of the core 60. This knockout operation can be carried out at high speed and is very reliable. As discussed above, the segments can be provided with internal rails 44 which are defined along grooves 90 provided in the core.

The rear segment 42 of the mount 10 is formed in a manner similar to the front segment 40 and need only be briefly described. More specifically, lower rib 32 of the rear segment 42 is formed along the parting line between the core and the cavity mold halves. Since the rear segment 42 of the mount 10 does not require a rib on the upper surface of the base 20, the parting line defining the remainder of the segment extends along the vertical plane defining the segments shown at A in FIG. 2. Preferably, after the segments have been formed and assembled, they are ultrasonically welded together.

In summary, there has been described a new and improved plastic mount 10 for a stamping die and a method for forming the same. The mount 10 is defined by an elongated tubular base 20 of rectangular cross section, having a handle 22 projecting upwardly from the top surface of the base. The bottom surface of the base 20 includes a pair of longitudinally extending parallel lower ribs 30, 32 formed contiguous with the front and rear surfaces of the base. The mount is formed from interconnected front and rear segments 40, 42 defined by a central vertical plane extending parallel to the longitudinal axis of the base 20. The front segment 40 further includes a pair of rib portons 54 spaced apart such that a separation S is defined therebetween which is aligned with the handle 22 and is at least as large as the longitudinal width of the handle at its juncture with the base. The rib portions 54 cooperate with the lower rib 30 on the front segment 40 to receive and retain a C-shaped transparent strip 50 thereon to enable a card 52 bearing indicia, to be interposed between the strip and the front surface of the base. The subject mount 10 is manufactured in accordance with an improved method wherein cam action mechanisms are not required. More specifically, the front segment 40 is formed between core and cavity mold halves 60, 62 with the parting line, between the mold halves, defining the bottom surface of the base 20 extending along the associated lower rib 30. Similarly, a portion of the parting line defining the top surface of the base extends along the rib portions 54. The parting line defining the remainder of the front segment 40 corresponds to and extends along the vertical plane defining the segment itself. By this arrangement, the part may be readily removed from the mold by a knockout pin arrangement such that manufacturing costs are minimized.

While the subject invention has been explained with reference to a preferred embodiment, it will be obvious that other changes and modifications could be made therein by one skilled in the art without departing from the scope and spirit of the subject invention as defined by the appended claims.

What is claimed is:

1. A hollow plastic mount for a stamping die, said mount being defined by an elongated tubular base of rectangular cross section having closed ends, opposed top and bottom surfaces and opposed front and rear surfaces, said mount further including a generally tubular handle projecting upwardly from the center of said top surface of said base, the bottom surface of said base including a pair of longitudinally extending parallel lower ribs projecting downwardly from said bottom surface contiguous with the front and rear surfaces of said base respectively and defining a boundary for the placement of a stamping die, said mount formed from unitary front and rear segments defined by a central vertical plane extending parallel to the longitudinal axis of said base, said front and rear segments being connected together, with said front segment further including a means, cooperating with the lower rib formed on said front segment, adapted to receive a longitudinally extending C-shaped, transparent strip along the front surface of said base, such that a card bearing incicia identifying said stamping die may be readily displayed by interposing said card between said strip and the front surface of said base, said means including a pair of longitudinally extending rib portions projecting upwardly from the upper surface of said base contiguous with the front surface thereof, said rib portions being spaced apart such that a separation is defined therebetween, said separation being aligned with said handle and being at least as large as the longitudinal width of said handle at its juncture with said base, said rib portions cooperating with the lower rib formed on said front segment to receive and hold said transparent strip.

2. A plastic mount as recited in claim 1 wherein the opposed ends of said rib portions extend towards but are spaced from the adjacent ends of said base.

3. A plastic mount as recited in claim 1 wherein said front and rear segments include internal rails for adding structural rigidity thereto.

4. A plastic mount as recited in claim 1 wherein the inner surface of one of said segments includes a plurality of locking pins and wherein the inner surface of the other said segment includes corresponding apertures to facilitate the alignment and interconnection between said segments.

5. A plastic mount as recited in claim 1 wherein said handle includes a cylindrical stem portion formed integrally with said base and wherein said stem portion flares outwardly and upwardly into a knob portion.

6. A plastic mount as recited in claim 5 wherein said knob portion of said handle includes a planar area to facilitate the printing of indicia thereon.

7. A plastic mount as recited in claim 1 wherein said front and rear segments are ultrasonically welded together.

* * * * *